US005079043A

United States Patent [19]

Lambert

[11] Patent Number: 5,079,043

[45] Date of Patent: Jan. 7, 1992

[54] METHOD FOR SPRAYING A COATING ON A DISK

[75] Inventor: Richard W. Lambert, Brookhaven, N.Y.

[73] Assignee: The Perkin-Elmer Corporation, Norwalk, Conn.

[21] Appl. No.: 621,508

[22] Filed: Dec. 3, 1990

[51] Int. Cl.[5] ..... B05D 1/10

[52] U.S. Cl. ..... 427/423; 427/34; 427/425; 427/427

[58] Field of Search ..... 427/34, 423, 425, 427

[56] References Cited

U.S. PATENT DOCUMENTS 4,457,259 7/1984 Samuels ..... 427/425 X
4,551,355 11/1985 Ericson et al. ..... 427/425 X
4,806,455 2/1989 LaBianca ..... 427/425 X

FOREIGN PATENT DOCUMENTS 638387 12/1978 U.S.S.R. ..... 427/425

*Primary Examiner*—Evan Lawrence
*Attorney, Agent, or Firm*—H. S. Ingham; E. T. Grimes

[57] ABSTRACT

In a method to spray a coating of uniform thickness onto a spinning disk, a point is located spacially on the spinning disk at a distance from the center equal to about half of a spray stripe width plus half of the disk radius. The spray stream is moved in a ring-shaped pattern centered at the point and having a perimeter defined at the stripe mid-line. The perimeter diameter is equal to the disk radius. The spray stream is moved around the pattern with successive speeds, namely a base speed for a semicircular outer zone at the periphery of the disk and a smaller inner zone at the center, and lesser speeds for intermediate zones. For a concentrically contoured disk, between the above cycles the spray stream is affixed perpendicularly to a slanted surface of the spinning disk for a time period sufficient to compensate for a thickness deficiency.

19 Claims, 3 Drawing Sheets

METHOD FOR SPRAYING A COATING ON A DISK

BACKGROUND OF THE INVENTION

This invention relates to spraying coatings, and particularly to the spraying of a coating of uniform thickness onto a circular area of a substrate.

Spraying of a coating of uniform thickness onto a disk or other circular area of a substrate presents unusual difficulties, particularly if the area has concentrically contoured elevations instead of being flat. Spraying of a flat surface is relatively easy and common, being effected by linear passes of overlapping spray stripes. Spray coating of the outer surface of a shaft is similarly done by slowly moving the spray stream lengthwise along a spinning shaft.

However, spraying onto a spinning disk ordinarily results in nonuniformity. If the spray stream is simply passed at constant speed over the spinning disk through the center, the coating will be much thicker at the center because the surface speed of the disk is slower there, being zero speed at the very center. The nonuniformity may be reduced by accelerating the movement of the stream from the edge toward the center, and decelerating from the center out. Very high speed, theoretically approaching infinite, is necessary but not very practical. The passes ay be made slightly off-center, but the problem still is not solved, partly because spray gun manipulators such as robots are designed to operate in steps and are not generally capable of smooth accelerations and decelerations. Therefore, there is a need for a better method of making passes of a spray stream over a spinning disk.

The need for spraying such surfaces particularly relates to the top domes of pistons for internal combustion engines. Advanced diesel engines are incorporating pistons with ceramic coatings for running hotter and enhanced performance. These coatings are being produced with the thermal spray process.

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (149 microns) and about 2 microns. The material alternatively may be fed into a heating zone in the form of a wire. A thermal spray gun normally utilizes a combustion flame, an arc plasma stream or an electrical arc to produce the heat for melting of the powder particles.

SUMMARY OF THE INVENTION

An object of the invention is to provide a novel method for spraying a coating of uniform thickness onto a selected circular area of a substrate such as an end of a cylindrical member. Another object is to provide a method for spraying a coating of uniform thickness onto such a circular area having concentrically contoured elevations with a slanted surface. A further object is to provide an improved method for thermal spraying a ceramic coating onto the dome of a piston for an internal combustion engine.

The foregoing and other objects are achieved by a method of spraying a coating of uniform thickness onto a selected circular area of a substrate. The selected area is defined by a first center point and an area radius. A spray stream is generated with a spray coating device such that a spray pattern stripe is effected at the substrate upon relative lateral motion between the spray stream and the substrate, the stripe having a midline and an effective stripe width. The substrate is set spinning about an axis through the first center point normal to the selected area.

The spray pattern is ring-shaped with a perimeter defined by the stripe midline. The pattern is spacially fixed with respect to the spinning substrate so that the center point is outside the spray pattern with the perimeter being spaced laterally from the center point by about one stripe width and the spray pattern having an outer portion located outside of the selected area. The spray device is manipulated so as to move the spray stream around a ring-shaped spray pattern on the spinning substrate.

In a preferred embodiment the spray pattern is centered on a central radial line delineated so as to extend from the first center point along the spinning substrate to a spacially fixed point outside the selected area. The perimeter diameter and the radial location of the second center point are selected cooperatively so that the perimeter is spaced from the first center point by about half of the stripe width and the perimeter has a portion thereof outside of the selected area. The central line thereby has an inner line segment from the second center point to the first center point and an outer line segment from the second center point to the outside point.

Further according to the preferred embodiment, the spray pattern is divided into arcuate zones consisting of a generally semicircular outer zone nominally centered on the outer line segment, an inner zone substantially smaller than the outer zone and encompassing the inner line segment, and two intermediate zones respectively separating the inner and outer zones at each side thereof. The spray device is manipulated so as to move the spray stream around the ring-shaped spray pattern with successive speeds for the zones relative to a selected base speed. The speeds for the outer and inner zones are substantially equal to the base speed, and the speeds for the intermediate zones are substantially less than the base speed.

A further aspect of the invention is directed to the selected circular area of the substrate having concentrically contoured elevations therein providing a slanted surface component so as to cause a coating thickness deficiency with the preceding step of manipulating the spray device. Between the forgoing cycles of moving the spray stream around the spray pattern, the spray device is further manipulated in auxiliary steps comprising orienting the spray device to a slanted orientation, moving the spray device so that the spray stream is directed substantially perpendicular to the slanted surface component of the spinning substrate, and holding the spray device in the slanted orientation for a time period sufficient to compensate for the thickness deficiency. These steps are advantageously alternated with the cycles of moving the spray stream around the spray pattern, until a selected coating thickness is attained.

DETAILED DESCRIPTION OF THE INVENTION

Figure 1:
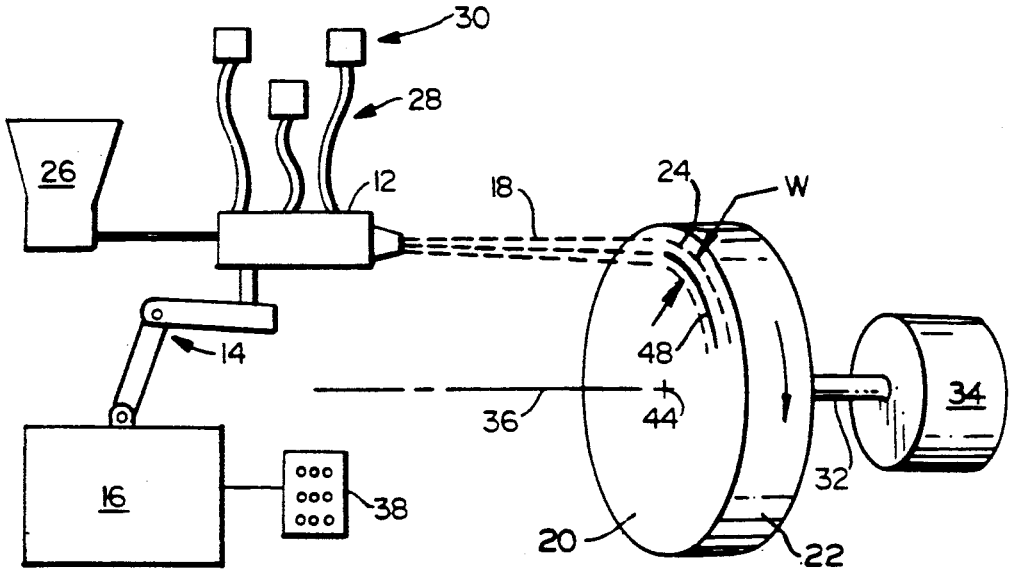
FIG. 1 is a schematic drawing of an apparatus for carrying out the invention.

With reference to FIG. 1, a spray coating device 12 is mounted on arms 14 of a manipulator 16. The device may be any conventional spray coating gun suitable for producing the desired coating with a spray stream of definable width, for example a plasma or combustion type of thermal spray gun or a paint spray gun; the present example is directed to a thermal spray gun. The gun produces a spray stream 18 which is aimed substantially normally to a selected circular area 20 of a substrate 22 to be coated such as an end of a cylindrical member. A particular useful application is the dome of a piston for an internal combustion engine where a very uniform coating of a ceramic such as zirconia is to be applied.

Figure 2:
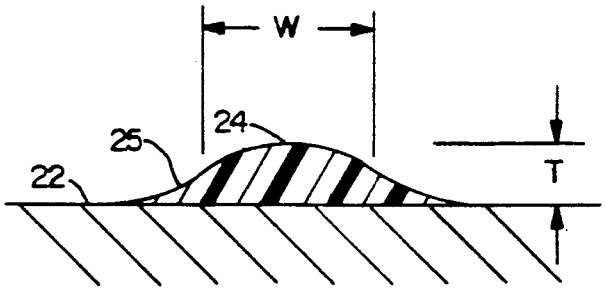
FIG. 2 is a cross section of a spray pattern stripe effected with the apparatus of FIG. 1.

A pattern stripe 24 is effected on the spinning substrate. The stripe will have a typical cross section as shown in FIG. 2. An effective width W of the stripe is not exact but is generally considered to be that width which delineates the portion of coating stripe having at least half of the maximum stripe thickness T. This is subject to adjustment as indicated herein, and overspray 25 outside this region is to be utilized.

A powder feeder 26 is provided for supplying ceramic powder to the gun, as well as gas supply lines 28 and gas sources 30 as required for operation of the gun. The substrate is prepared conventionally such as with grit blasting and/or a metallic bond coat, and may be preheated prior to powder feed. The piston 22 (or other substrate) is mounted on a shaft 32 driven by a motor 34 for spinning the end-surface 20 under the spray stream 18, about an axis 36 normal to the substrate surface area to be coated. The manipulator 16 such as a Metco Type AR1000 robot sold by the Perkin-Elmer Corporation is computerized and programmed to move the gun so that the spray pattern is moved with varying positions and velocities over the coating surface according to the invention in a manner described below. Programming of a conventional robot is readily done with a pendent 38 or computer keyboard as supplied or recommended by the manufacturer of the robot.

Figure 3:
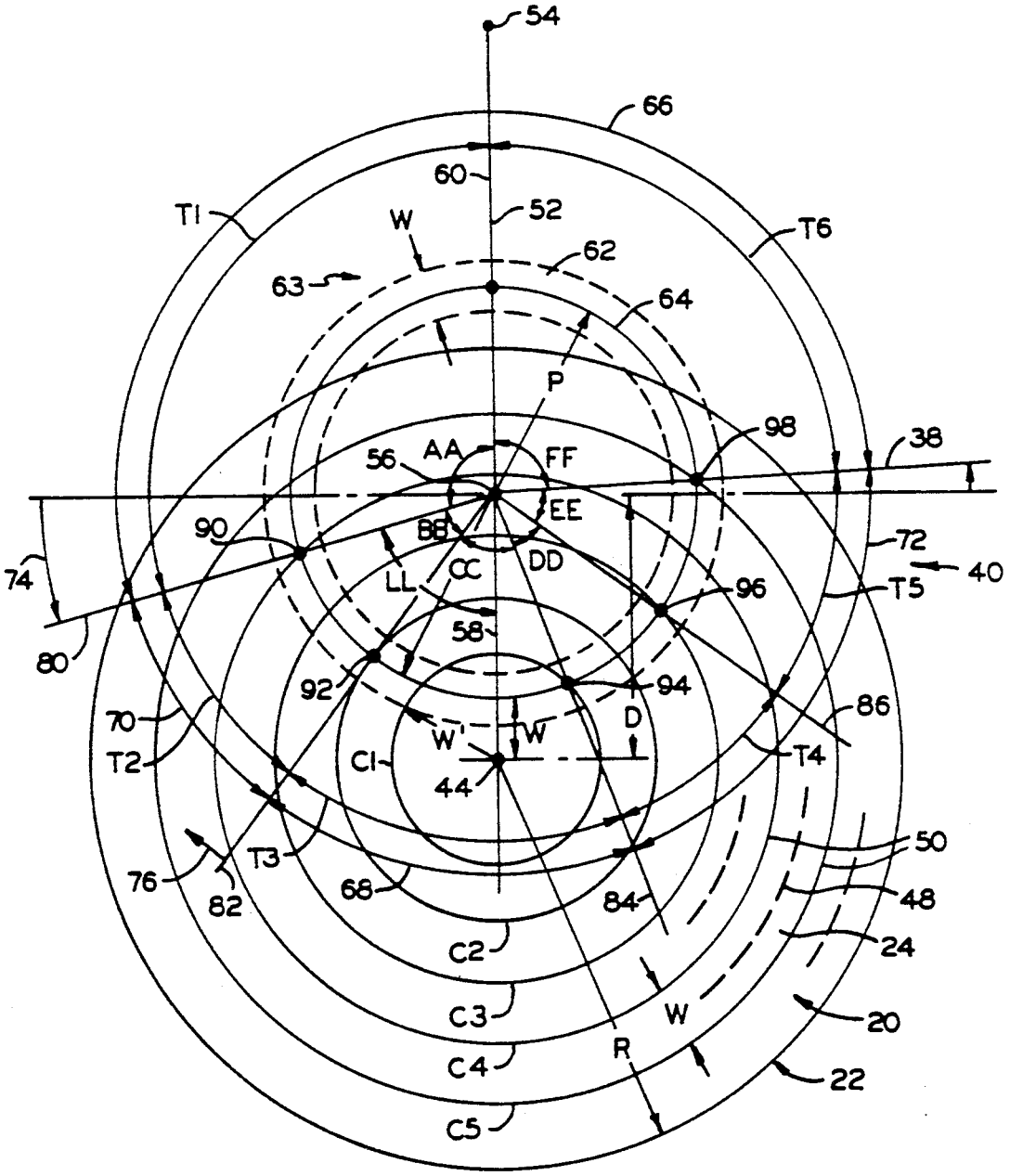
FIG. 3 is a drawing of geometric patterns associated with the invention.

FIG. 3 shows geometric patterns 40 associated with the invention. The selected circular area 20 or disk-shaped substrate for coating is in the plane of the drawing. The selected area is defined by a first center point 44 and an area radius R. This radius is about 6 cm in the present example. The spray device (not shown in FIG. 3) is above this plane by the desired spray distance, e.g. by about 10 cm. Relative lateral motion between the spray stream and the substrate produces a spray pattern on the substrate which, for a stationary gun over the spinning area, is a circular stripe such as stripe 24 with a mid-line 48 and an effective width W. In the present example the area to be coated has a radius R of about 6½ (six and one half) such pattern widths, delineated in the drawing with five concentric circles 50. The innermost circle should have a radius W' about 1½ (one and one half) times the width W.

A hypothetical central radial line 52 is delineated fixed in space as extending from the first center point 44 along the spinning substrate 22 to a spacially fixed point 54 outside the selected area 20. A second center point 56 is located on the central line 52 at a distance D from the first center point 44 substantially equal to the width W plus half of the area radius R. The center line 52 is conveniently described as having an inner line segment 58 between the second center point 56 and the first center point 44, and an outer line segment 60 between the second center point 56 and the outside point 54; the exact location of the outside point 54 is not important, and may provide a starting point for the spraying operation.

The spray device 12 (FIG. 1) is firstly manipulated so that the spray stream 18 is moved in a ring-shaped spray pattern 62 (delineated with dashed-line circles in FIG. 3) centered at the second point 56. The spray pattern 62 is defined by a spray pattern stripe with its stripe width W (as if the disk were stationary) and has a perimeter 64 defined by the stripe mid-line and further has a perimeter diameter P substantially equal to the radius R of the selected area 20. This geometry places a portion 63 (less than about half) of the spray pattern 62 outside of the selected area.

In a broad aspect of the invention, the spray pattern 62 is divided arcuately into zones. An outer zone 66 (shown in FIG. 3 by the arc of the zone) is generally semicircular and is nominally centered on (i.e. bisected by) the outer line segment 60. An inner zone 68 is substantially smaller than the outer zone and encompasses the inner line segment 58. The full circle of the pattern is completed with each of two intermediate zones 70,72 respectively separating the inner and outer zones at each side.

Preferably, as indicated in FIG. 3, the outer zone 66 is skewed in an arcuate direction 74 from being bisected by the outer line segment 60. This skewing is shown as counter-clockwise in the figure. Similarly the inner zone 68 is skewed in an opposite direction 76 from the arcuate direction, from being bisected by the inner line segment 58. The opposite skewing is clockwise in the present example. An objective of the skewings, and a result, is a narrowing of the left intermediate zone 70 and a corresponding broadening of the right intermediate zone 72. During the coating process, simultaneously with being moved around in the ring-shaped spray pattern 62, the spray device 12 is secondly manipulated so that the spray stream 18 (FIG. 1) moves around in the spray pattern with successive speeds relative to a selected base speed. Broadly, the speeds are substantially equal to a selected base speed for the outer and inner zones 66,68, and substantially less than the base speed for the intermediate zones 70,72.

The combination of the herein specified size and location of the ring-shaped spray pattern, and this selection of speeds, should result in a sprayed coating that has a relatively uniform thickness across the selected coating area 20. Although the disk center 44 is just outside the edge of the pattern 62, fringe spray is sufficient to coat the center region without excess thickness.

The exact location of the pattern center 56 may be adjusted and fine tuned as necessary to effect this result.

For further precision the zones are more specifically divided into sectors that arcuately divide the spray pattern. The number of sectors will depend on the radius R of the coating area relative to the pattern width W. For a radius of about 4 to 10 such widths the following sector arrangement should be quite suitable. A larger area in terms of a radius of a greater number of pattern widths should have more sectors.

Considering the sectors in detail for the present example of a six-width area radius R as shown, the arrangement is as follows: A first sector T1 extends from the outer line segment 60 through an angle AA marginally greater than 90°. A second sector T2 extends from the first sector by an angle BB equal to about half of an angle LL between the first sector and the inner line segment 58. A sixth sector T6 extends in the opposite direction from the first sector starting at the outer line segment 60 through an angle FF about equal to or marginally less than 90°. A fifth sector T5 extends from the sixth sector by an angle EE about equal to or marginally greater than the angle BB. A fourth sector T4 extends from the fifth sector by an angle DD about equal to the angle EE. Lastly, a third sector T3 fills in between the second and fourth sectors through an angle CC such that about one third of the third sector is between the inner line segment 58 and the fourth sector.

The term "marginally" as used herein and in the claims generally refers to an angle increment of up to about 20% of the referenced angle. Most preferably for this arrangement, angle AA is about 100°, angle BB is about 35°, angle CC is about 70°, angle DD is about 35°, angle EE is about 40°, and angle FF is about 80°. All sector angles add up to 360°, the sectors being non-overlapping. It may be seen that the first and sixth sectors together form the outer zone 66. The second sector constitutes the left intermediate zone 70, and the fourth and fifth sectors constitute the right intermediate zone 72.

For preferable speeds, the first, third and sixth sectors each has substantially the base speed, the second sector has between about 25% and 30% of base speed, the fourth sector has about twice the second sector speed, and the fifth sector has between about 30% and 40% of base speed. Most preferably the second sector speed is about 28% of base speed, the fourth sector speed is about 60% of base speed, and the fifth sector speed is about having more sectors, speeds for the additional sectors will be selected between these speeds so as to provide a grading of the speeds.

The sectors are advantageously described further in terms of hypothetical concentric circles nominally separated by the spray pattern widths on the selected coating area. These are illustrated in FIG. 3 as five such circles designated C1, C2, C3, C4 and C5 consecutively from the center. The circles have separations nominally equal to the stripe width W. It should be recognized that the cross section of a pattern stripe has a profile as shown in FIG. 2, so that selection of a spray pattern width is not exact. Therefore, the width as used herein is generally selected so that the circles fit evenly over the area, with the width otherwise being as closely as practical to about half of the maximum thickness of a single-pass stripe.

The concentric circles include an outermost circle C5 with a radius of one stripe width less than the area radius. An adjacently outer circle C4 is adjacent to the outmost circle. An innermost circle C1 has a radius of about 1½ stripe widths, and an adjacently inner circle C2 is adjacent to the innermost circle. In the present example there is one middle circle C3. In other cases for other circular spray radii R relative to a pattern width W, there may be other middle circles, or even no middle circle. The concentric circles intersect the pattern perimeter 64 to define points of intersection therewith. These points of intersection are used to define a series of radial lines extending from the second center point 56 through the intersection points.

One boundary for the first sector T1 is the outer line segment 52. The other boundary is a first radial line 80 through a point of intersection 90 of the pattern perimeter 64 with circle C4. This also is a boundary for the second sector T2. The other boundary for the second sector is a fourth radial line 82 through a point of intersection 92 of the pattern perimeter with the circle C2, which also is a boundary for the third sector T3. The other boundary for the third sector is a third radial line 84 through a point of intersection 94 of the pattern perimeter with the circle C1 such that the third sector encompasses the inner line segment 58. The latter boundary 84 is also for the fourth sector T4, which has as its other boundary a radial line 86 through a point of intersection 96 of the pattern circle and circle C3. The latter radial line 86 is also a boundary for the fifth sector T5 which has as its other boundary a second radial line 88 through a point of intersection 98 of the pattern circle with circle C5. The latter boundary 88 also is for the sixth sector T6 which completes the pattern of sectors to the outer line segment 52.

It will be appreciated that there are two points of intersection of the pattern perimeter 64 with each concentric circle. However any apparent ambiguity in defining intersection points for the radial lines is removed herein and in the claims by the more fundamental definitions for the sectors set forth. The radial lines merely fine tune these definitions. Specifically, in its direction of skewing, the outer zone is bounded by the first radial line 80; and, in the opposite direction, by the second radial line 88. Similarly, in its direction of skewing, the inner zone is bounded by the third radial line 82; and in the opposite direction, by the fourth radial line 84.

More generally, for other ratios of coating radius to pattern width, each of the intermediate zones is divided into at least one intermediate sector, each such sector having an arc width of nominally twice a minimum width defined between radial lines through points of intersection of the pattern perimeter with adjacent concentric circles. To determine specific speeds for these sectors, a preliminary speed is first estimated for each intermediate sector relative to the base speed. A coating is then produced on a disk with the selected area according to the steps described above, coating thickness is next measured such as with a micrometer at various locations across the selected area, and any excess or deficiency in thickness is correlated to concentric circles associated with an intermediate sector at the pattern perimeter.

A new speed is then selected for the associated sector, namely a faster speed if the thickness was excessive, or a slower speed for a deficient thickness. A further coating is spraying with the adjusted speed or speeds, so as to produce the further coating with a more uniform thickness on the selected area. Thickness measurements on the new coating may be made, leading to still further adjustments to the speeds, in a limited iterative process.

Only one or two repetitions should be necessary, so that such experimenting will not be excessive.

The concentric circles of the pattern widths provide a useful way to visualize the action of the spray stream through each sector of the circular pattern stripe. Skewing the sectors or zones by essentially one pattern width from symmetry about the central line provides for effectively overlapping coating depositions at the different surface speeds from the center on the spinning disk, so as to smooth out coating thickness differences at different distances from the first center point.

The spinning of the substrate should be at a constant rotational rate. Also the selected base speed (i.e. the speeds for the outer and inner zones) should be much less than the surface velocity (from the spinning) of the periphery of the selected area at its area radius R, preferably at least an order of magnitude less.

Figure 4:
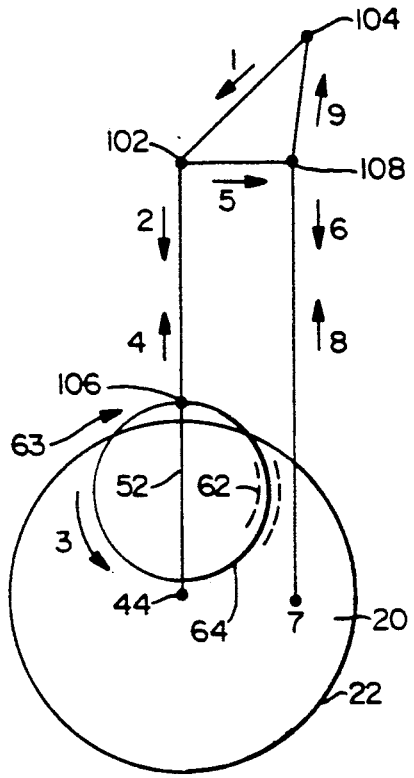
FIG. 4 is a schematic drawing showing paths for a spray stream in carrying out the invention.

FIG. 4 illustrates supplementary steps of moving the spray stream into and out of the spray pattern on the selected area. These steps, also programmed into the robot, make use of the fact that the ring-shaped spray pattern 62 has the portion 63 outside of the selected area 20. A reference point 102 is selected well away from the substrate (and may coincide with the outside point 54, FIG. 3). At the start of a cycle, the spray gun is lit at a starting point 104 and moved (1) to the reference point 102 where feeding of powder (or other material form) is turned on so that the spray stream is operative at the reference point. The spraying gun is then moved (2) so that the spray stream is taken to pattern 62 at a point of intersection 106 of the central radial line 52 with the pattern perimeter 64 outside of the selected area 20. The manipulation of the gun to move (3) the spray stream around the pattern at the selected speeds is effected as set forth above, and the spray stream is exited from the spray pattern at said point of intersection 106 after at least one cycle of the spray stream around the spray pattern, and moved (4) back to the reference point 102. The number of continuous cycles may be whatever is necessary for buildup of a coating of desired thickness, e.g. 1 mm, or other steps may be interjected between cycles as described above.

Figure 5:
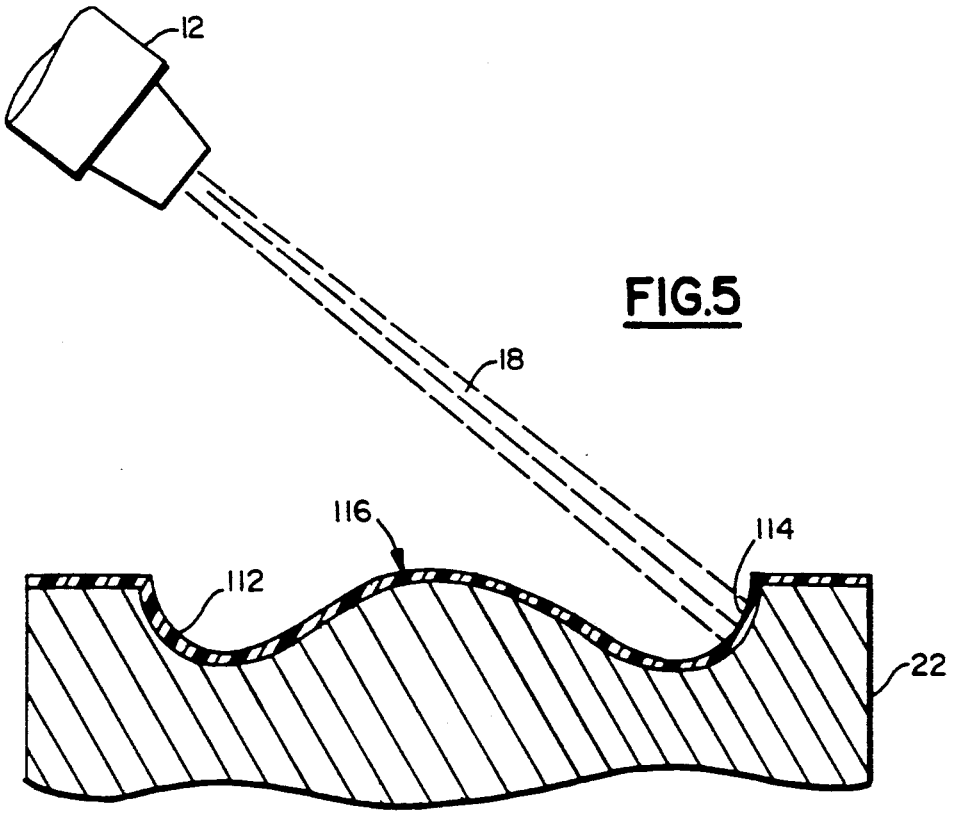
FIG. 5 is a cross section of a portion of a substrate with contours, showing a spray device producing a coating thereon according to a further aspect of the invention.

A particular case for further manipulating the spray device in auxiliary steps in the method is where the substrate 22 such as a piston dome has concentrically contoured elevations therein providing a slanted component 112 in the surface. An example is shown in FIG. 5. A nearly vertical slant 112 will to cause a coating thickness deficiency in the associated area when sprayed normal to the (mean) surface. Also, a coating sprayed at only low angle to a surface may be of poor quality. To solve these problems, the method further comprises, between cycles of the spray stream around the spray pattern, thirdly manipulating the spray device in a set of auxiliary steps presented next below.

Referring back to FIG. 4, after a cycle as described above, the gun is (optionally) moved (5) from the reference point to a convenient nearby point 108. There the spray device is oriented from its normal (perpendicular) direction to a slanted orientation. The spray device is then moved (6) into a position (7) selected so that the spray stream 18 is directed so as to be substantially perpendicular to the slanted surface component of the spinning substrate, as shown in FIG. 5. The spray device 12 is held in the slanted orientation for a time period sufficient to add to the slanted coating 114 to compensate for the thickness deficiency, the time being generally less than for one normal cycle of spraying. The device again is moved (8) so that the spray stream is withdrawn out of the selected area and back to the convenient point 108.

Advantageously there is continuously alternating between the auxiliary steps and cycle of the spray stream around the spray pattern until a selected thickness for a coating 114 is reached. At this stage, at or near the reference point, powder feeding is stopped and the gun is shut down or moved (9) back into an idle mode position 104. This total sequence of steps produces a particularly uniform, high quality coating 116 on a circularly contoured surface such as that of FIG. 5.

As an example the dome of a 12.5 cm diameter piston having a configuration as in FIG. 5 was thermal spray coated with Metco 202 zirconium oxide powder to a thickness of about 1 mm using the geometry of FIG. 3. A Metco Type 7MB plasma spray gun with a G4 nozzle was used with a Type AR1000 robot. The zirconia was sprayed at 12.5 cm spray distance with nitrogen plasma gas using standard parameters. The piston was spinning at 650 rpm and the base speed was 75 cm/sec.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A method of spraying a coating onto a selected circular area of a substrate with the selected area having a center point, the method comprising:

generating a spray stream with a spray coating device such that a spray pattern stripe is effected at the substrate upon relative lateral motion between the spray stream and the substrate, the stripe having a midline and an effective stripe width;

spinning the substrate about an axis through the center point normal to the selected area; and manipulating the spray device so as to move the spray stream around in a ring-shaped spray pattern over the spinning substrate, the spray pattern having a perimeter defined by the stripe midline and being spacially fixed with respect to the spinning substrate so that the center point is outside the spray pattern, the perimeter being spaced laterally from the center point by about one stripe width and the spray pattern having an outer portion located outside of the selected area.

2. The method according to claim 1 wherein the step of manipulating comprises manipulating the spray device so as to move the spray stream around the ring-shaped spray pattern with successive speeds selected to effect a coating of uniform thickness on the selected area.

3. The method according to claim 2 further comprising dividing the spray pattern into arcuate zones consisting of a generally semicircular outer zone nominally centered on the outer portion, an inner zone proximate the center point and substantially smaller than the outer zone, and two intermediate zones respectively separating the inner and outer zones at each side thereof, and wherein the step of manipulating comprises manipulating the spray device so as to move the spray stream around the ring-shaped spray pattern with successive speeds for the zones relative to a selected base speed, the speeds for the outer and inner zones being substantially equal to the base speed, and the speeds for the intermediate zones being substantially less than the base speed.

4. A method of spraying a coating of uniform thickness onto a selected circular area of a substrate, the selected area being defined by a first center point and an area radius, comprising:

generating a spray stream substantially normal to the selected area with a spray coating device such that a spray pattern stripe is effected at the substrate upon relative lateral motion between the spray stream and the substrate, the stripe having a mid-line and an effective stripe width;

spinning the substrate about an axis through the first center point normal to the substrate;

delineating a central radial line extending from the first center point along the spinning substrate to a spacially fixed point outside the selected area;

establishing a ring-shaped spray pattern with the spray stream over the spinning substrate, the spray pattern being centered at a second center point located on the center line in the selected area, the spray pattern having a perimeter defined by the stripe mid-line, the perimeter having a perimeter diameter selected cooperatively with the location of the second center point so that the center point is located outside the spray pattern with the perimeter being spaced laterally from the first center point by about one stripe width and the spray pattern having a portion thereof located outside of the selected area, the central line thereby having an inner line segment extending between the second center point and the first center point and an outer line segment extending between the second center point and the outside point;

dividing the spray pattern into arcuate zones consisting of a generally semicircular outer zone nominally centered on the outer line segment, an inner zone substantially smaller than the outer zone and encompassing the inner line segment, and two intermediate zones respectively separating the inner and outer zones at each side thereof; and manipulating the spray device so as to move the spray stream around the ring-shaped spray pattern on the spinning substrate with successive speeds for the zones relative to a selected base speed, the speeds for the outer and inner zones being substantially equal to the base speed, and the speeds for the intermediate zones being substantially less than the base speed.

5. The method according to claim 4 wherein the outer zone is skewed in an arcuate direction from being bisected by the outer line segment, and the inner zone is skewed oppositely from the arcuate direction from being bisected by the inner line segment.

6. The method according to claim 5 wherein the second center point is located on the central line at a distance from the first center point substantially equal to the stripe width plus half of the area radius, and the perimeter diameter is substantially equal to the area radius.

7. The method according to claim 6 wherein the step of dividing comprises:

forming concentric circles within and concentric to the selected area and having separations nominally equal to the stripe width, the concentric circles including an outermost circle with radius of one stripe width less than the area radius, an adjacently outer circle adjacent to the outmost circle, an innermost circle with a radius of about 1½ stripe widths, and an adjacently inner circle adjacent to the innermost circle, the concentric circles intersecting the pattern perimeter to define points of intersection therewith;

forming first and second radial lines extending from the second center point, the first radial line being defined to extend through a point of intersection for the outermost circle, and the second radial line being defined to extend through a point of intersection for the adjacently outer circle, the first and second radial lines providing respective boundaries for the outer zone; and forming third and fourth radial lines extending from the second center point, the third radial line being defined to extend through a point of intersection for the innermost circle, and the fourth radial line being defined to extend through a point of intersection for the adjacently inner circle, the third and fourth radial lines providing respective boundaries for the inner zone.

8. The method according to claim 7 wherein the step of dividing further comprises dividing each of the intermediate zones into at least one intermediate sector, each such sector having an angular width of nominally twice a minimum angular width defined between radial lines extending through adjacent points of intersection of the pattern perimeter with adjacent concentric circles, and the method further comprises, in sequence, estimating a preliminary speed for each intermediate sector relative to the base speed, producing a coating on the selected area with each preliminary speed according to the step of manipulating, measuring coating thickness across the selected area, correlating any excess or deficiency in thickness to concentric circles associated with an intermediate sector at the pattern perimeter, selecting for the associated sector a faster speed for an excess thickness or a slower speed for a deficient thickness, and producing a further coating with the faster or slower speed according to the step of manipulating, so as to produce the further coating with a more uniform thickness on the selected area.

9. The method according to claim 4 wherein the step of dividing comprises dividing the spray pattern into non-overlapping sectors, a first sector extending from the outer line segment through an angle A marginally greater than 90°, a sixth sector extending from the outer line segment oppositely from the first sector through an angle F marginally less than 90°, a second sector extending from the first sector by an angle B marginally less than half of an angle between the first sector and the inner line segment, a fifth sector extending from the sixth sector by an angle E about equal to or marginally greater than the angle B, a fourth sector extending from the fifth sector by an angle D about equal to the angle B, and a third sector extending between the second and fourth sectors by an angle C such that about one third of the third sector is between the inner line segment and the fourth sector, whereby the outer zone consists of the first and sixth sectors, the inner zone consists of the third sector, and the intermediate zones consist of the second, fourth and fifth sectors; and wherein the speed for each of the first, third and sixth sectors is substantially equal to the base speed, the speed for the second sector is between about 25% and 30% of the base speed, the speed for the fourth sector is about twice the second sector speed, and the speed for the fifth sector is between about 30% and 40% of the base speed.

10. The method according to claim 9 wherein angle A is about 100°, angle B is about 35°, angle C is about 70°, angle D is about 35, angle E is about 40°, and angle F is about 80.

11. The method according to claim 10 wherein the speed for the second sector is about 28% of base speed, the speed for the fourth sector is about 60% of base speed, and the speed for the fifth sector is about 36% of base speed.

12. The method according to claim 4 wherein the spinning of the substrate is at a constant rotational rate.

13. The method according to claim 4 wherein the spinning of the substrate effects a surface speed of the selected area at the area radius, and the base speed is at least an order of magnitude less than the surface speed.

14. The method according to claim 4 further comprising supplementary steps of first entering the spray stream into the ring-shaped spray pattern at a point of intersection of the central radial line with the pattern perimeter outside of the selected area, and subsequently exiting the spray stream out of the spray pattern at said point of intersection after at least one cycle of the spray stream around the spray pattern.

15. The method according to claim 4 wherein the selected area of the substrate has concentrically contoured elevations therein providing a slanted surface component so as to cause a localized coating thickness deficiency upon effecting the step of manipulating, and the method further comprises, separately from the step of manipulating, further manipulating the spray device in auxiliary steps comprising orienting the spray device to a slanted orientation, moving the spray device so that the spray stream is directed substantially perpendicular to the slanted surface component of the spinning substrate, and holding the spray device in the slanted orientation for a time period sufficient to compensate for the thickness deficiency.

16. The method according to claim 15 further comprising continuously alternating between the auxiliary steps and the cycles of moving the spray stream around the spray pattern until a selected coating thickness is attained.

17. The method according to claim 4 wherein the spray device is a thermal spray gun.

18. The method according to claim 4 wherein the substrate is a cylindrical member with an end constituting the substrate and having the selected circular area.

19. The method according to claim 18 wherein the cylindrical member is an internal combustion engine piston with a dome constituting the selected area, the spray device is a thermal spray gun, and the spray stream comprises a ceramic spray material.

* * * * *

UNITED STATES PATENT AND TRADEMARK OFFICE

CERTIFICATE OF CORRECTION

PATENT NO. : 5,079,043

DATED : January 7, 1992

INVENTOR(S) : Richard W. Lambert

It is certified that error appears in the above-indentified patent and that said Letters Patent is hereby corrected as shown below:

In column 5, line 49, after "about" insert --36% of base speed. With a significantly larger coating area--.

In column 6, line 64, change "spraying" to --sprayed--.

Signed and Sealed this

Fifth Day of October, 1993

Bruce Lehman

*Attest:*

BRUCE LEHMAN

*Attesting Officer*

*Commissioner of Patents and Trademarks*